US008387430B2

(12) United States Patent
Marin et al.

(10) Patent No.: US 8,387,430 B2
(45) Date of Patent: Mar. 5, 2013

(54) TUBE ROLLING PLANT

(75) Inventors: Paolo Marin, Vigevano (IT); Vincenzo Palma, San Giovanni (IT); Marco Ghisolfi, Muggio (IT); Guido Emilio Zanella, Milan (IT); Jacopo Grassino, Giaveno (IT); Alberto Vittorio Maria Bregante, Milan (IT)

(73) Assignee: SMS Innse SpA, S. Donato Milanese (IT)

( * ) Notice: Subject to any disclaimer, the term of this patent is extended or adjusted under 35 U.S.C. 154(b) by 0 days.

(21) Appl. No.: 13/329,172

(22) Filed: Dec. 16, 2011

(65) Prior Publication Data

US 2012/0137745 A1 Jun. 7, 2012

Related U.S. Application Data

(63) Continuation of application No. PCT/IB2010/052699, filed on Jun. 16, 2010.

(30) Foreign Application Priority Data

Jun. 19, 2009 (IT) ..... MI2009A001085
Jan. 28, 2010 (IT) ..... MI2010A000113
Apr. 19, 2010 (IT) ..... MI2010A00666

(51) Int. Cl.
*B21B 19/08* (2006.01)

(52) U.S. Cl. ..... 72/96; 72/208; 72/370.01

(58) Field of Classification Search ..... 72/95, 96, 72/97, 98, 99, 100, 208, 209, 370.01, 370.14, 72/370.25

See application file for complete search history.

(56) References Cited

U.S. PATENT DOCUMENTS 3,552,170 A * 1/1971 Pfeiffer et al. ..... 72/209
4,353,238 A * 10/1982 Breton et al. ..... 72/209
4,404,832 A * 9/1983 Pfeiffer et al. ..... 72/209
4,487,049 A * 12/1984 Danchenko et al. ..... 72/208
5,501,091 A * 3/1996 Hayashi ..... 72/13.4
5,548,988 A * 8/1996 Proske et al. ..... 72/252.5
6,116,071 A * 9/2000 Cernuschi et al. ..... 72/224
6,128,934 A * 10/2000 Houghton ..... 72/10.3
7,093,469 B2 * 8/2006 Yamane ..... 72/9.2

FOREIGN PATENT DOCUMENTS

EP 0601932 A1 6/1994
EP 1479457 A1 11/2004
EP 1611969 A1 1/2006
EP 1918034 A1 5/2008

(Continued)

OTHER PUBLICATIONS

International Search Report mailed Sep. 20, 2010 for PCT Application No. PCT/IB2010/052699.

(Continued)

*Primary Examiner* — Edward Tolan
(74) *Attorney, Agent, or Firm* — Perkins Coie LLP

(57) ABSTRACT

The present invention relates to a system and method for rolling a seamless tube. The plant comprises a main rolling mill with adjustable rolls for mandrel-rolling a semi-finished tube. The plant also comprises a fixed-roll extracting/reducing mill positioned downstream of the main rolling mill. The extracting/reducing mill is designed to extract the semi-finished tube from the mandrel and reduce its diameter to a predetermined value close to that desired for the finished tube. Finally, the plant comprises a adjustable-roll sizing mill. The sizing mill is positioned downstream of the extracting/reducing mill. This sizing mill is designed to adjust the radial position of the rolls and define the diameter of the outgoing tube.

16 Claims, 4 Drawing Sheets

FOREIGN PATENT DOCUMENTS

| | | | | |
|---|---|---|---|---|
| GB | 2099346 | | * | 12/1982 |
| GB | 2128121 | A | | 4/1984 |
| GB | 2199519 | A | | 7/1988 |
| JP | 55147408 | A | | 11/1980 |
| JP | 56-95409 | | * | 8/1981 |
| JP | 57103714 | A | | 6/1982 |
| JP | 58196109 | A | | 11/1983 |
| WO | WO-2010146546 | A1 | | 12/2010 |

OTHER PUBLICATIONS

Fujisawa et al.: "Improvement of size availability in medium-diameter seamless steel pipe mill", Revue de Metallurgie—Cahiers D'Informations Techniques, Revue de Metallurgie. Paris, FR LNKD-DOI: 10.1051/Metal:2006122, vol. 103, No. 12, Dec. 1, 2006, pp. 552-557.

Written Opinion mailed Sep. 20, 2010 for PCT Application No. PCT/IB2010/052699.

International Search Report and Written Opinion for Application No. MI20091085, Feb. 11, 2010.

International Search Report and Written Opinion for Application No. MI20100113, Sep. 10, 2010.

International Search Report and Written Opinion for Application No. MI20100666, Sep. 13, 2010.

* cited by examiner

TUBE ROLLING PLANT

RELATED APPLICATIONS

This application is a U.S. Continuation Application of International Application No. PCT/IB2010/052699, filed Jun. 16, 2010, which claims priority to Italian Patent Application Nos. MI2009A001085, filed Jun. 19, 2009, MI2010A000113, filed Jan. 28, 2010, and MI2010A00666, filed Apr. 19, 2010, all of which are hereby incorporated by reference in their entirety.

BACKGROUND

Seamless metal tubes can be produced by successive plastic deformation of a starting billet. First, the billet is heated in a furnace to a temperature of about 1220-1280° C. Then the billet is pierced longitudinally to obtain a pierced semi-finished article with a thick wall and a length 1.5 to 4 times longer than that of the starting billet. Next, a mandrel is introduced into this semi-finished article. This semi-finished article is then passed through a rolling mill (referred to below as "main rolling mill") that can gradually thin the wall by means of suitable diameter-reducing operations and increase the length of the finished product. As is well known, the rolling mill comprises a plurality of rolling units. Each unit comprises a stand on which rolls with profiled grooves are mounted. Usually, a system comprises three profiled rolls and the profiles of the grooves of the three rolls, all connected together, define the outer profile of the tube produced by the rolling unit.

As mentioned above, the main rolling mill requires the arrangement of a mandrel inside the tube being processed to counter the radial thrust exerted by the rollers during rolling. In order to exert this counter action, the mandrel must be extremely stiff in the radial direction. Moreover, in order to ensure a high-quality finish for the inner surface of the tube, the mandrel must have an outer surface which is as smooth as possible. Because of this requirement, it would be extremely difficult to manufacture mandrels consisting of several parts joined together. The joining zone is in fact necessarily characterized by an irregular surface. Moreover, this zone would be too delicate to withstand the radial rolling pressure.

Use of a retained mandrel, where the mandrel is both axially constrained and retained so as to advance at a controlled speed, is well known. This solution has a notable drawback. The single section of the mandrel, while being constrained, is advanced axially along the rolling mill and is thus engaged in full deformation conditions in successive rolling stations. Inside the rolling stations, the mandrel is subjected to high thermal and mechanical stresses due to the deformation energy and the friction produced by the sliding contact of the tube material. The passage through more than one rolling station therefore causes a significant increase in the mandrel temperature, thereby resulting in the need to provide several mandrels which are identical to each other. The multiple mandrels allow each one of them to be suitably cooled at the end of rolling and then lubricated for the next rolling cycle. In addition to this, it must be considered that the individual mandrel must be made entirely of a particularly high-quality material in order to withstand the stresses typically arising during rolling. From the above, it is clear that a considerable outlay is required for the mandrel stock in order to be able to ensure operation of the main rolling mill.

Downstream of the main rolling mill, the tube is extracted from the mandrel and the final finishing operations are performed so as to obtain a tube which is able to comply with suitable quality control standards. The main parameters which must be verified are the wall thickness and the outer diameter of the tube. At present two different types of plant which are able to perform the final finishing operations are known.

A first type of plant envisages an extracting mill, downstream to the main rolling mill and in series, capable of extracting the semi-finished tube from the mandrel. This extracting mill usually comprises three stands.

During the subsequent processing operations, it is no longer possible to directly modify the thickness of the tube wall. It is therefore advisable, in this type of plant, to carry out a control of the wall thickness soon after the extractor. In this way, if the semi-finished tube has a wall thickness which is different from the desired thickness it is possible to perform automatic adjustment of the main rolling mill so as to correct the thickness along the following tube sections.

A sizing mill is positioned, off-line, downstream to the extractor and the thickness control point. This sizing mill comprises a plurality of fixed stands (usually 10-12) which are able to define the final diameter of the tube so that it complies with the required standard. In order to obtain a good result in terms of the diameter, it is advisable to ensure a uniform temperature for the tube inside a suitable furnace so that uniform contraction of the tube is also achieved during subsequent cooling. During this processing step, the tube exiting from the main rolling mill may have different temperatures along the various sections, depending on the geometric conditions of the tube and transient factors during the process. Therefore, the furnace which precedes the sizing mill must have dimensions that allow the entire tube to be housed internally so that the tube may have a uniform temperature of about 950° C.

Following the action of the sizing mill, the final diameter of the tube is brought into compliance with the desired standard. The wall thickness, however, may fail to comply with the standard because sizing mill modifies the thickness of the wall in an uncontrollable and sometimes unpredictable manner. Downstream to the sizing mill, a station for controlling the final thickness of the tube may also be provided and may, if necessary, correct the thickness of the semi-finished article upstream, within the main rolling mill. It is clear, however, that this control operation is performed at a later stage and that the conditions which caused a deviation of the thickness from the required standard may have, in the meantime, changed again, thereby invalidating the effectiveness of the control operation.

This first type of plant, although widely used, is not without drawbacks. Firstly, the furnace arranged between the extracting mill and the sizing mill represents an additional outlay and, since it must remain constantly in operation, generates high running costs. Moreover, from a logistical point of view, the fixed-roll sizing mill requires a large mandrel stock in order to be able to adapt to the different diameters required, different steels used and their characteristics. Finally, as mentioned above, a control of the final thickness of the tube wall is performed indirectly and is thus unable to ensure small tolerance values.

A second type of known plant envisages the arrangement, extracting/sizing mill downstream and in series to the main rolling mill. This extracting/sizing mill comprises a plurality of adjustable-roll stands and is thus able to extract the tube from the mandrel and control the final tube diameter. A control of the wall thickness is performed just after the extracting/sizing mill. In this way, if the finished tube has a wall thickness which is different from the desired thickness, it is possible to perform automatic adjustment of the main rolling mill so as to correct the thickness along the following tube sections.

Although this type of plant is clearly more compact than the plant described previously, there are a number of drawbacks which make use of the plant not particularly advantageous. The extracting/sizing mill comprises many adjustable stands (10-12), making it very complex and expensive. Moreover, accurate control of the tube diameter cannot be performed on-line. It should be remembered that, at the end of the rolling process, the tube moves along the plant at a speed of about 5-6 m/s. It is therefore very difficult to implement feedback control which allows checking of the tube parameters and real-time modification of the rolling mills. This difficulty is increased when there are variations in temperature along the tube. These temperature variations cannot be effectively compensated for and can result in corresponding variations in the final diameter of the tube.

The object of the present invention is therefore to overcome, at least partly, the drawbacks mentioned in the above prior art references. In particular, a task of the present invention is to provide a continuous rolling plant which allows more effective control over both the outer diameter and the wall thickness of the finished tube. Moreover, a task of the present invention is to provide a continuous rolling plant which requires a smaller initial outlay and lower running cost. Finally, a task of the present invention is to provide a continuous rolling plant which allows simpler management from a logistical point of view.

DETAILED DESCRIPTION

The present invention relates to a system and method for the continuous rolling of seamless tubes, in particular the continuous rolling of seamless tubes with a medium-to-large diameter. The characteristic features and advantages of the invention will emerge from the description, provided below, of a number of embodiments, provided by way of non-limiting examples.

The plant for rolling a seamless tube, according to the invention, comprises a main rolling mill for mandrel-rolling a semi-finished tube, wherein the radial position of the rolls in the mill are adjustable. The plant according to the invention also comprises a fixed-roll extracting/reducing mill, positioned downstream and in series to the main rolling mill. This extracting/reducing mill is designed to extract the semi-finished tube from the mandrel and to reduce the diameter of the semi-finished tube to a predetermined value close to that desired for in the finished tube.

Finally, the plant, according to the invention, also comprises a sizing mill of the type in which the radial position of the rolls is adjustable. This sizing mill is positioned downstream and off-line to the extracting/reducing mill.

With reference to the rolling plant, it is possible to define specifically a rolling axis, which is the longitudinal axis of a tube being processed. "Radial" will therefore indicate the direction of a straight half-line which is perpendicular to the axis and has its origin thereon. In accordance with certain embodiments of the plant, according to the invention, the main rolling mill uses a slow mandrel. In the present description, the term "slow mandrel" is understood as meaning a mandrel which is retained so that none of its sections is subject to the action of two successive rolling stations. Particularly, with reference to the attached FIG. 4, the following equation is obtained:

$$V_m < d/T_1$$

where $V_m$ is the speed of the mandrel 32; d is the minimum interaxial distance between two successive rolling stands 34; and $T_1$ is the rolling time. Also applicable is the equation:

$$T_1 = L_t/V_t$$

where $L_t$ is the length of the tube 20 and $V_t$ is the axial speed of the tube 20 along the rolling mill 30.

From the above description, it can be understood that the mandrel 32, required for operating the main rolling mill 30 in the plant, may be relatively short. The minimum length required will be equal to the overall interaxial distance D (i.e. the distance between the first and last rolling station) in addition to the displacement $S_m$ which the mandrel 32 performs during the rolling time: $S_m = V_m T_1$. The above equations also give the following value: $S_m < d$.

Figure 1:
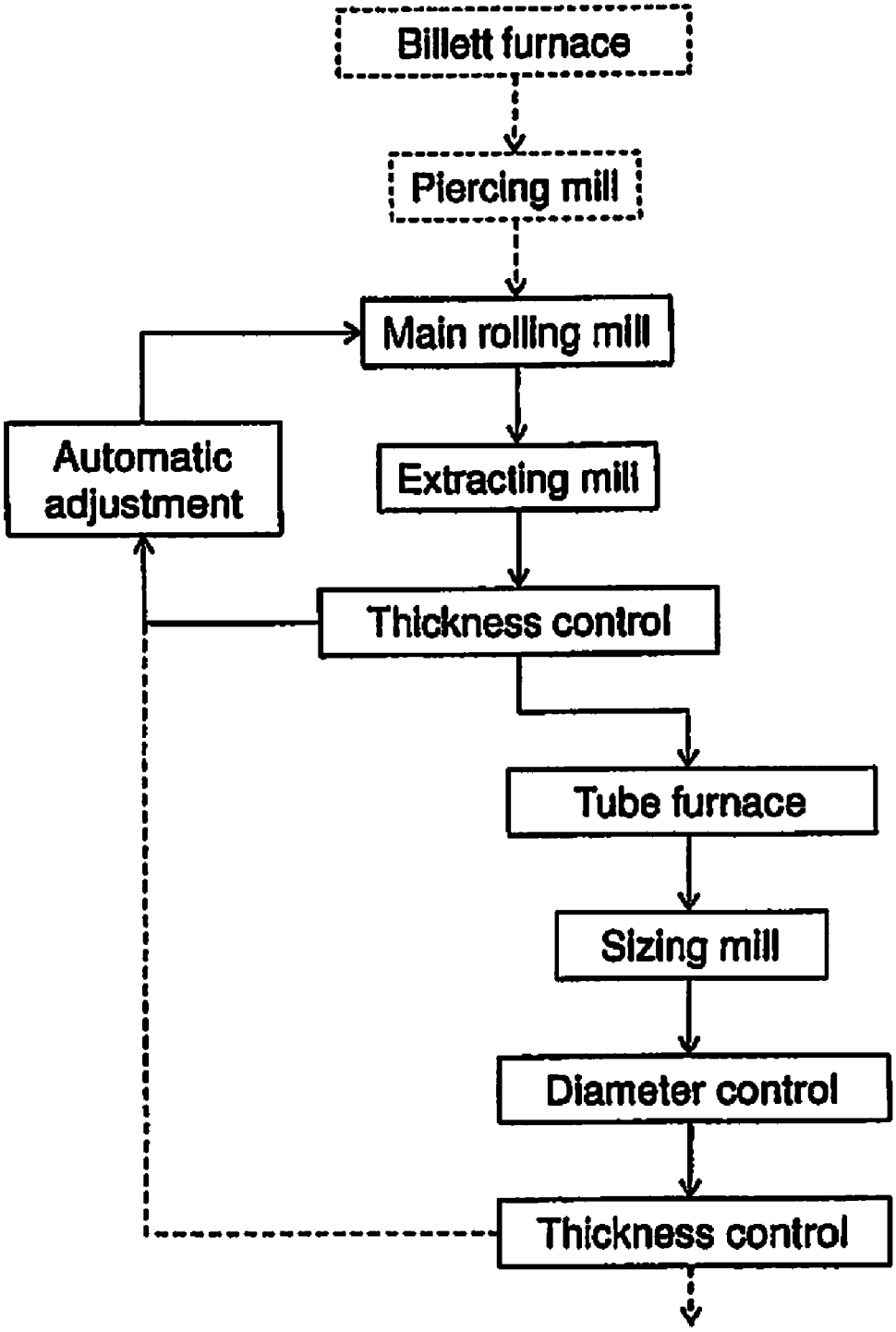
FIG. 1 shows a block diagram representing a first type of rolling plant according to the prior art.
Figure 2:
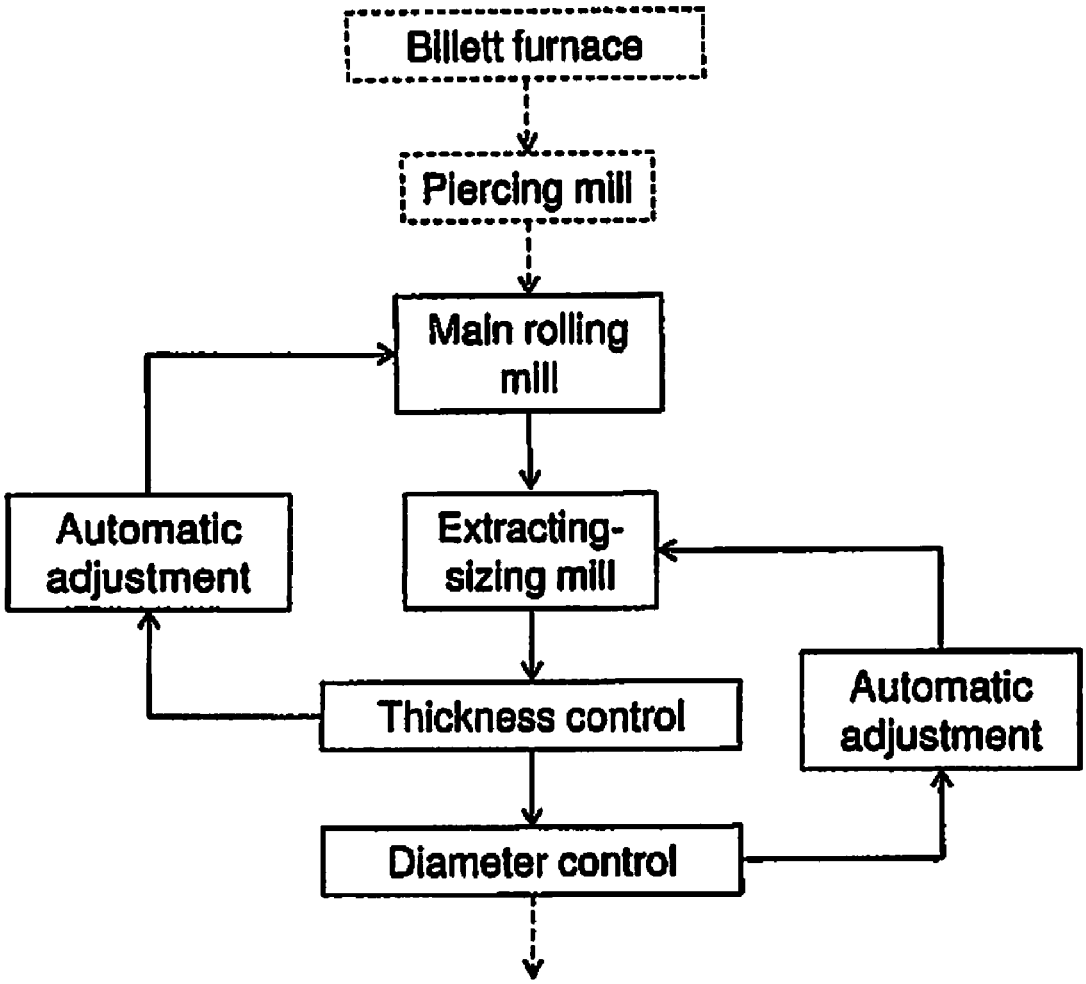
FIG. 2 shows a block diagram representing a second type of rolling plant according to the prior art.
Figure 3:
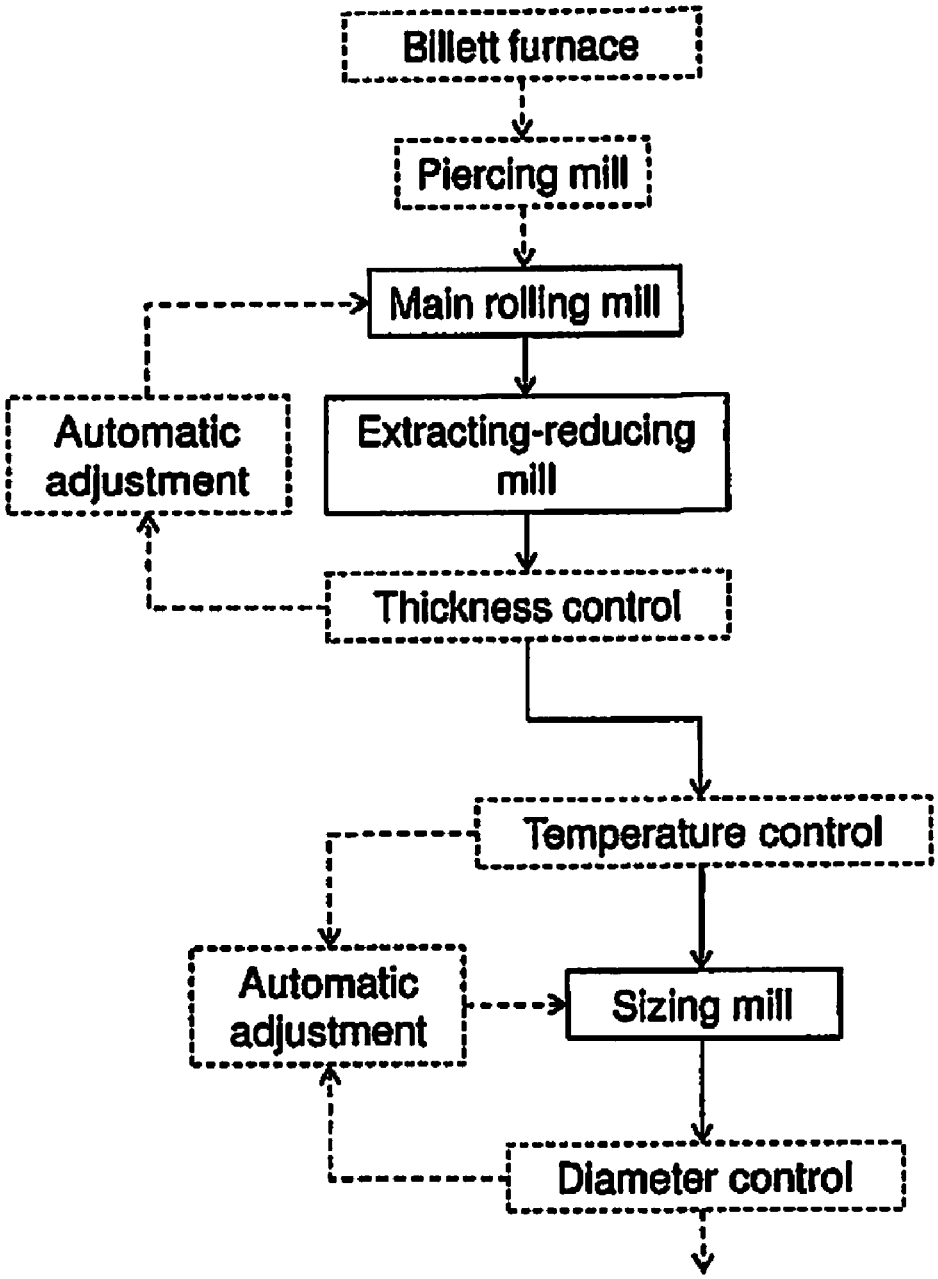
FIG. 3 shows a block diagram representing a rolling plant according to the invention.
Figure 4:
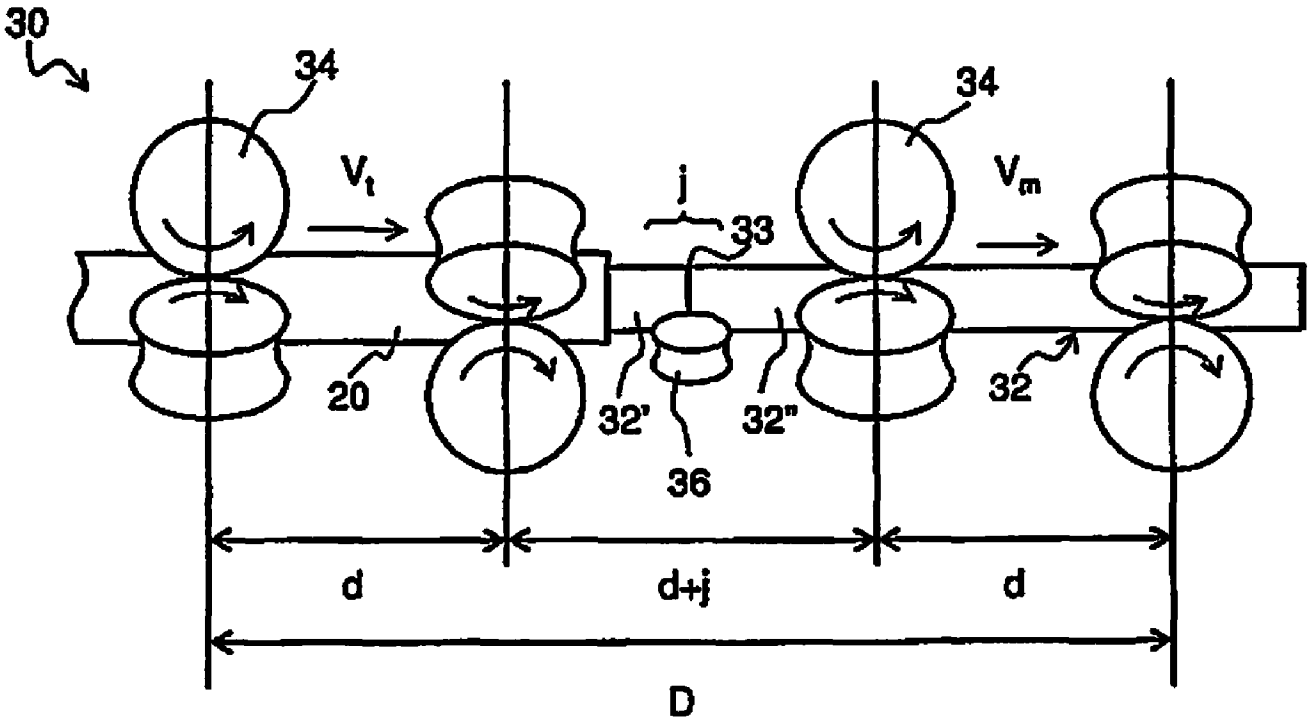
FIG. 4 shows schematically the continuous main rolling mill used in the plant according to the invention.

In the embodiment shown in FIG. 4, the main rolling mill 4 is simplified and comprises only four stands. Below reference will be made for the sake of greater descriptive clarity to this simplified embodiment, but the person skilled in the art may immediately understand how the same concepts may be applied to rolling mills with more than 4 stands.

The speed of the mandrel $V_m$ is extremely slow and this allows a limited displacement $S_m$ of the mandrel 32. Considering the average values typically assumed by the variables indicated above, the minimum length of the mandrel 32, equivalent to $D+S_m$, will be between 5 and 6 metres. This length allows manufacturing of a mandrel 32 at a decidedly lower cost than conventional retained mandrels.

Moreover, since each individual section of the mandrel is subject to the action of only one rolling stand, the overall heating of the mandrel during the process is limited. The limited heating makes it possible to manufacture the mandrel using materials which are less expensive than those used for conventional faster mandrels, without any negative consequences.

The lower temperature of the slow mandrel at the end of rolling also allows for more rapid cooling. This allows a substantial reduction in the number of mandrel specimens which are required for the production of a single type of tube. The reduction in the mandrel stock as a whole obviously gives rise to substantial economic and logistical advantages.

Moreover, as can be noted in the attached FIG. 4, the three interaxial distances separating the four rolling stands 34 are not all the same. The first interaxial distance d, which separates the first stand from the second stand, and the third interaxial distance d, which separates the third stand from the fourth stand, are substantially the same. However, the second interaxial distance, which separates the second stand from the third stand, is greater than the other two distances. A mini support stand 36 for the mandrel 32 is positioned between the second rolling stand and third rolling stand as the mandrel would otherwise cantilever protrude along the rolling mill 30.

It is assumed, as in FIG. 4, that the second interaxial distance is greater by a distance j than the other two; each of the sections of the mandrel 32, during the entire rolling process, travels along a section having at the most a length $S_m < d$. In connection with the second interaxial distance, it is therefore possible to identify a section of the mandrel 32 of length at least equal to j which does not undergo any rolling either by the second stand or by the third stand. This section of length j is therefore available for providing a joint 33 between two portions 32' and 32" of the mandrel 32. Still with reference to the example considered above, the two portions 32' and 32" of the mandrel 32 would each have a length of between 2.5 and 3 metres. With these lengths, it is possible to drastically simplify the manufacturing and management of the mandrel 32.

Moreover, using a composite mandrel, there exists the option of replacing, where required, only the worn portion. In contrast, when using conventional non-composite mandrels, the entire mandrel must be replaced even if it is subject to only local wear. Moreover, when using a composite mandrel, there exists the possibility of using high-quality materials only for the portions which are most subject to stress (usually those portions which are engaged within the first rolling stands) and using less expensive materials for the portions which are less stressed. These possibilities offered by the composite mandrel significantly reduce the operating costs of the rolling mill. With the slow composite mandrel solution adopted here, it is thus possible to provide a main rolling mill which is extremely competitive on the market.

In accordance with certain embodiments, the rolling plant according to the invention comprises, downstream to the extracting/reducing mill, means for measuring the wall thickness of the tube. In these embodiments, the main rolling mill is able to adjust the radial position of the rolls depending on the measurement of the wall thickness of the tube.

In accordance with certain embodiments, the sizing mill according to the invention comprises means for measuring the temperature of the incoming tube and means for measuring the diameter of the outgoing tube. In these embodiments, the sizing mill is able to adjust the radial position of the rolls depending on the temperature measurements of the incoming tube and the diameter measurements of the outgoing tube.

In accordance with certain embodiments, the rolling plant according to the invention comprises, upstream to the main rolling mill, a furnace for heating a billet and a piercing mill to pierce the billet longitudinally. The billet is pierced longitudinally so as to obtain a pierced semi-finished article with a thick wall and length 1.5 to 4 times longer than that of the starting billet.

In accordance with one embodiment, the rolling plant according to the invention comprises, downstream to the sizing mill, an apparatus for cooling the tube down to room temperature and a cutting station able to cut the tube into predetermined lengths.

The plant according to the invention is particularly suitable for rolling seamless tube with a medium-to-large diameter. This latter expression refers to diameters greater than 168.3 mm (6⅝ inches) and typically refers to diameters between 168.3 mm and 508 mm (20 inches).

According to one embodiment of the invention, the extracting/reducing mill comprises 8-12 fixed-roll rolling stands. This mill is referred to as an extracting/reducing mill because it is able to extract the tube being processed from the mandrel and to reduce the diameter of the semi-finished tube to a predetermined value close to the final value.

As mentioned above, downstream of the extracting/reducing mill, means for measuring the wall thickness of the tube are optionally provided, measurements which are used to adjust the radial position of the rolls of the main rolling mill. The possibility of directly modifying the wall thickness of the tube is limited to the main rolling mill which operates with mandrel. The following extracting/reducing mill instead operates without mandrel and is able to directly modify the tube diameter. Modification of the diameter by the extracting/sizing mill involves, by way of a secondary effect, a variation in the thickness. This variation, however, cannot be determined precisely in advance.

According to one embodiment of the invention, the sizing mill comprises 2-3 rolling stands of the type with radially adjustable rolls. These rolling stands with adjustable rolls may, for example, be similar to those described in the patent EP 0921873 granted to the same applicant. The sizing mill is able to reduce the diameter of the tube to the predetermined value required for the finished tube.

By employing adjustable rolls in the sizing mill, it is possible to obtain different final diameters, where variation in diameter of up to 3.5 mm using the same set of rolls is possible. Also, the wear of the rolls may be compensated for by increasing their working life. Finally, the thermal contraction variations for the materials and the differing thicknesses may be controlled. Thus, for an entirely acceptable variation, a major reduction in the stock of rolls supplied with the rolling mill is achieved. This reduction may be estimated at at least 30%, with reference to the overall stock of rolls (extracting/reducing mill and sizing mill).

As mentioned above, the sizing mill is not arranged in series with the previously described parts of the plant. This means that the tube may be moved, during this processing step, at an axial speed which is decidedly slower than that the tube reaches at the end of the preceding processing steps. Typically, upon leaving the main rolling mill, inside which it is subject to greatest increase in speed, the tube travels at about a speed of 5-6 m/s. The optimum rolling speed for calibration of the outer diameter of the tube has instead been established as being in the range of about 1.2 m/s and 2.5 m/s. In accordance with one embodiment of the plant according to the invention, the tube travels at about 1.5 to 2 m/s within the sizing mill.

At these feeding speeds, temperature of the incoming tube and the diameter of the outgoing tube can optionally be taken into consideration, in real time, to control the radial position of the sizing rolls. The possibility of controlling, in real time, the movement of the rolls depending on the tube temperature therefore means that differences in temperature along the said tube may be managed. In this way it is no longer required to provide a furnace to ensure a uniform temperature of the tube. With this plant, it is possible to achieve an optimum finish of the tube and thus able to obtain the desired diameter within very small tolerances.

It should be noted here that, in contrast to that stated for the first type of plant of the prior art, final calibration of the tube diameter does not have any substantial effect on the wall thickness. In fact, calibration is performed, in the plant according to the invention, by means of a small number of rolling stands with adjustable rolls. On the other hand, in the plant of the known type, final calibration was performed by means of a dozen or so stands with fixed rolls.

As a result, the tolerance with regard to the nominal wall thickness obtained by means of the plant according to the invention is usually 20% better than that achieved in the prior art with the first type of plant. In particular, in the claimed invention, the tolerance for the wall thickness is limited, even in the most critical cases with thin wall thickness or high-alloy steels, to within ±7% (3σ). On the other hand, the tolerance with respect to the nominal wall thickness obtained in the known plants of the first type is usually in the range of up to ±9%. As with the known plants of the second type, however, the tolerance with respect to the nominal thickness is relatively small, but the tolerance with respect to the diameter has a very wide spread.

It must be remembered here that large-diameter tubes, especially if they have a thin walls, are commonly subjected to ovalization due to their intrinsic weight. In fact, in some temperature conditions, the metallic materials are subject to creep, i.e. an increasing deformation under constant stress. This phenomenon occurs at temperatures above half the melting point of the material, measured in Kelvin. These conditions occur in recently finished tubes in the known plant of the second type. In fact, when leaving the fixed-roll extracting/sizing mill, the tube still has a fairly high temperature of about 1000° C.

In the plant according to the invention, the temperature of the recently finished tube exiting the sizing mill is markedly lower (about 850° C.) than the temperature of the recently finished tube exiting the known plant of the second type, resulting in considerable reduction in the phenomenon of ovalization due to creep.

The invention also relates to a method for rolling seamless tubes, typically large-diameter tubes. The rolling method according to the invention comprises mandrel-rolling a pierced semi-finished article in a main rolling mill with adjustable rolls until a semi-finished tube is obtained; extracting the semi-finished tube from the mandrel; reducing the diameter of the semi-finished tube to a predetermined value, wherein the steps of extracting the mandrel and reducing the diameter of the semi-finished tube are achieved by means of a single fixed-roll extracting/reducing mill positioned downstream of the main rolling mill; and finally, calibrating the diameter of the tube to a predetermined value, wherein calibration of the tube diameter is performed by a sizing mill, positioned downstream and off-line to the extracting/reducing mill, in which the radial position of the rolls is adjustable. In accordance with certain embodiments, the rolling method according to the invention also comprises the steps of measuring the thickness of the tube wall downstream of the extracting/reducing mill and, depending on this measurement, adjusting the radial position of the rolls of the main rolling mill.

In accordance with certain embodiments of the rolling method according to the invention, the step of calibrating the tube diameter is performed by adjusting the radial position of the rolls depending on measurement of the temperature of the tube entering the sizing mill and depending on measurement of the diameter of the tube leaving the sizing mill.

In accordance with certain embodiments, the rolling method according to the invention may comprise other steps before the step of mandrel-rolling a pierced semi-finished article. In particular, the rolling method according to the invention may comprise the steps of heating a billet in a furnace and longitudinally piercing the billet so as to obtain the pierced semi-finished article with a thick wall.

In accordance with certain embodiments, the rolling method according to the invention may comprise other steps after the step of calibrating the tube diameter. In particular, the rolling method according to the invention may comprise the steps of cooling the tube down to room temperature and cutting it into predefined lengths.

As mentioned above, the step of calibrating the tube diameter is not performed in series with the preceding steps of the method. This means that the tube may be moved, during this processing step, at an axial speed which is decidedly slower than that the tube reaches at the end of the preceding processing steps. Typically, upon leaving the main rolling mill, inside which it is subject to greatest increase in speed, the tube travels at about a speed of 5-6 m/s. The optimum rolling speed for calibration of the outer diameter of the tube has instead been established as being in the range of about 1.2 m/s and 2.5 m/s. In accordance with one embodiment of the plant according to the invention, the tube travels at about 1.5 to 2 m/s within the sizing mill.

At these feeding speeds, temperature of the incoming tube and the diameter of the outgoing tube can optionally be taken into consideration, in real time, to control the radial position of the sizing rolls. The possibility of controlling, in real time, the movement of the rolls depending on the tube temperature therefore means that differences in temperature along the said tube may be managed. In this way it is no longer required to provide a furnace to ensure a uniform temperature of the tube. With this plant, it is possible to achieve an optimum finish of the tube and thus able to obtain the desired diameter within very small tolerances.

It should be noted that, in the claimed invention, it is possible to obtain, compared to the prior art, a better distribution of the subsequent deformation required for production of the finished tube. In particular, with reference to the overall deformation which is required to convert the billet into the finished tube, prior art involves 60% deformation within the main rolling mill, 10% deformation within the extracting mill, and the remaining 30% deformation within the sizing mill. In contrast, the claimed invention involves 60% deformation within the main rolling mill, 30% deformation within the extracting/reducing mill, and the remaining 10% deformation within the sizing mill. This redistribution of the deformation is particularly convenient because it significantly increases the deformation which occurs immediately downstream of the main rolling mill (from 10% to 30%), where the tube is still very hot. As will be clear to the person skilled in the art, the claimed invention at least partly overcomes the drawbacks described with respect to the prior art.

With regard to the embodiments according to the claimed invention, the person skilled in the art may, in order to satisfy specific requirements, make modifications to and/or replace elements described with equivalent elements, without thereby departing from the scope of the accompanying claims.

What is claimed is:

1. A system for rolling a seamless tube, comprising:

a main rolling mill for rolling a semi-finished tube with a mandrel, wherein the main rolling mill includes a first plurality of rolls having adjustable radial positions;

a fixed-roll extracting/reducing mill positioned downstream from the main rolling mill and in series therewith, wherein the extracting/reducing mill includes a second plurality of rolls having a fixed radial position and comprises 8-12 rolling stands and wherein the extracting/reducing mill is configured to extract the semi-finished tube from the mandrel and reduce the diameter of the semi-finished tube to a value that is proximate to a first desired final diameter of a completed version of the semi-finished tube;

a sizing mill positioned downstream to the extracting/reducing mill and off-line with respect thereto, the sizing mill including a third plurality of rolls having adjustable radial positions, wherein the sizing mill comprises 2-3 rolling stands.

2. The system of claim 1, further comprising, means for measuring a wall thickness of the semi-finished tube, the said means positioned downstream to the extracting/reducing mill; and wherein the main rolling mill is configured to adjust the radial position of each of the first plurality of rolls according to a measured wall thickness of the semi-finished tube leaving the extracting/reducing mill.

3. The system of claim 1, wherein the sizing mill further comprises: means for measuring a temperature of a given tube entering the sizing mill and means for measuring a diameter of the given tube leaving the sizing mill; and wherein the sizing mill is configured to adjust the radial position of each of the third plurality of rolls according to the temperature and the diameter of the given tube.

4. The system of claim 1, wherein the system further comprises: a furnace for heating a billet upstream from the main rolling mill; and a piercing mill for piercing the billet longitudinally.

5. The system of claim 1, wherein the system further comprises: a cooling apparatus for cooling a given tube down to room temperature; and a cutting station for cutting the given tube into predetermined lengths, wherein the cooling apparatus and the cutting station are downstream of the sizing mill.

6. The system of claim 1, wherein the completed version of the semi-finished tube is a seamless tube with a finished diameter greater than 168.3 mm.

7. The system of claim 1, wherein, the semi-finished tube travels between 5-6 m/s in the extracting/reducing mill, and between 1.2-2.5 m/s in the sizing mill.

8. The system of claim 1, wherein the mandrel in the main rolling mill includes at least two portions and wherein a joint between the at least two portions of the mandrel is not engaged within any rolling station during rolling.

9. The system of claim 1, wherein;

the mandrel is retained in the main rolling mill such that none of sections of the mandrel is subjected to action of two successive rolling stations.

10. A method for rolling a seamless tube, the method comprising:

rolling a semi-finished article with a mandrel in a main rolling mill until a semi-finished tube is produced, wherein the main rolling mill includes a first plurality of rolls having adjustable radial positions;

extracting the semi-finished tube from the mandrel, the extraction performed using a fixed-roll extracting/reducing mill positioned downstream to the main rolling mill;

reducing the diameter of the semi-finished tube to a first predetermined value in the fixed-roll extracting/reducing mill, the fixed-roll extracting/reducing mill comprising 8-12 rolling stands; and calibrating the diameter of the semi-finished tube to a second predetermined value for a finished tube in a sizing mill positioned downstream to the extracting-reducing mill, wherein the sizing mill is off-line with respect to the fixed-roll extracting/reducing mill and comprises a third plurality of rolls having adjustable radial positions, and wherein the sizing mill comprises 2-3 rolling stands.

11. The method of claim 10, further comprising: measuring a wall thickness of a given tube processed by the extracting/reducing mill; and adjusting the radial position of the first plurality of rolls based on the measured wall thickness.

12. The method of claim 10, wherein calibrating the diameter of the semi-finished tube is performed by adjusting the radial position of the third plurality of rolls according to a temperature of the semi-finished tube entering the sizing mill and according to a diameter of a completed version of the semi-finished tube leaving the sizing mill.

13. The method of claim 10, further comprising: heating a billet in a furnace before rolling the semi-finished tube; and piercing the billet longitudinally to obtain the semi-finished article.

14. The method of claim 10, further comprising: cooling a given tube down to room temperature after calibrating the diameter; and cutting the given tube into predetermined lengths.

15. A system for rolling a seamless tube, comprising:

a main rolling mill for rolling a semi-finished tube with a mandrel, wherein the main rolling mill includes a first plurality of rolls having adjustable radial positions;

a fixed-roll extracting/reducing mill positioned downstream from the main rolling mill and in series therewith, wherein the extracting/reducing mill includes a second plurality of rolls having a fixed radial position and comprises 8-12 rolling stands and wherein the extracting/reducing mill is configured to extract the semi-finished tube from the mandrel and reduce the diameter of the semi-finished tube to a value that is proximate to a first desired final diameter of a completed version of the semi-finished tube;

a sizing mill positioned downstream to the extracting/reducing mill and off-line with respect thereto, the sizing mill including a third plurality of rolls having adjustable radial positions, wherein the sizing mill comprises 2-3 rolling stands and wherein the sizing mill has a rolling speed in the range of 1.2 meter per second to 2.5 meter per second.

16. A system for rolling a seamless tube, comprising:

a main rolling mill for rolling a semi-finished tube with a mandrel, wherein the main rolling mill includes a first plurality of rolls having adjustable radial positions;

a fixed-roll extracting/reducing mill positioned downstream from the main rolling mill and in series therewith, wherein the extracting/reducing mill includes a second plurality of rolls having a fixed radial position and comprises 8-12 rolling stands and wherein the extracting/reducing mill is configured to extract the semi-finished tube from the mandrel and reduce the diameter of the semi-finished tube to a value that is proximate to a first desired final diameter of a completed version of the semi-finished tube;

a sizing mill positioned downstream to the extracting/reducing mill and off-line with respect thereto, the sizing mill including a third plurality of rolls having adjustable radial positions, wherein the sizing mill comprises 2-3 rolling stands; and a thickness measure for measuring a wall thickness of the semi-finished tube, the thickness measure positioned downstream to the extracting/reducing mill; and wherein the main rolling mill is configured to adjust the radial position of each of the first plurality of rolls according to the measured wall thickness of the semi-finished tube leaving the extracting/reducing mill.

* * * * *